US010102792B2

(12) United States Patent
Huang et al.

(10) Patent No.: US 10,102,792 B2
(45) Date of Patent: Oct. 16, 2018

(54) DRIVING CIRCUIT OF DISPLAY PANEL AND DISPLAY APPARATUS USING THE SAME

(71) Applicant: Novatek Microelectronics Corp., Hsinchu (TW)

(72) Inventors: Ying-Neng Huang, Taichung (TW); Wen-Shen Wuen, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 86 days.

(21) Appl. No.: 15/086,035

(22) Filed: Mar. 30, 2016

(65) Prior Publication Data

US 2017/0287379 A1 Oct. 5, 2017

(51) Int. Cl.

| | |
|---|---|
| ***G09G 3/20*** | (2006.01) |
| ***G09G 3/36*** | (2006.01) |
| ***G09G 3/3283*** | (2016.01) |

(52) U.S. Cl.

CPC ..... *G09G 3/2092* (2013.01); *G09G 3/3283* (2013.01); *G09G 3/3685* (2013.01);

(Continued)

(58) Field of Classification Search

CPC ... G09G 2300/0842; G09G 2300/0871; G09G 2300/0866; G09G 2300/0838; G09G 3/3233; G09G 3/3283; G09G 3/3291; G09G 3/2092; G09G 2310/027; G09G 2310/0262; G09G 2310/286; G09G 2310/0289;

(Continued)

(56) References Cited

U.S. PATENT DOCUMENTS 5,751,263 A * 5/1998 Huang ..... G09G 3/20 345/82
6,806,859 B1 * 10/2004 Kanoh ..... G09G 3/3688 345/100

(Continued)

FOREIGN PATENT DOCUMENTS

| | | |
|---|---|---|
| CN | 1601595 | 3/2005 |
| TW | I246043 | 12/2005 |

(Continued)

OTHER PUBLICATIONS

"Office Action of Taiwan Counterpart Application", dated Mar. 8, 2017, p. 1-p. 5.

*Primary Examiner* — Dismery Mercedes
(74) *Attorney, Agent, or Firm* — JCIPRNET

(57) ABSTRACT

A driving circuit of a display panel and a display apparatus using the same are provided. The driving circuit includes a shift register, a latch, a level shifter, a current source and a charge switch. The shift register receives a trigger signal to provide a data latch signal. The latch couples to the shift register, and receives a gray-level data to latch and output the gray-level data according to the data latch signal. The level shifter couples to the latch and provides a charge switch signal according to the gray-level data. The current source provides a charge current. The charge switch couples between the current source and a pixel of the display panel, and receives the charge switch signal to determine whether the current source is coupled to the pixel according to the charge switch signal.

18 Claims, 7 Drawing Sheets

(52) U.S. Cl.
CPC ..... *G09G 2300/0871* (2013.01); *G09G 2310/027* (2013.01); *G09G 2310/0272* (2013.01); *G09G 2310/0286* (2013.01); *G09G 2310/0289* (2013.01); *G09G 2310/08* (2013.01); *G09G 2330/025* (2013.01); *G09G 2330/028* (2013.01); *G09G 2330/06* (2013.01)

(58) Field of Classification Search
CPC ... G09G 2320/0295; G09G 2320/0233; G09G 2320/029; G09G 2330/021
See application file for complete search history.

(56) References Cited

U.S. PATENT DOCUMENTS 7,075,342 B2 7/2006 Nishimura
7,304,628 B2 * 12/2007 Hashimoto ..... G09G 3/3688 345/213
7,321,246 B2 1/2008 Nishimura
7,561,147 B2 7/2009 Tsuge
7,683,862 B2 3/2010 Lee
7,839,356 B2 * 11/2010 Hagood ..... G02B 26/02 345/55
7,969,398 B2 * 6/2011 Shirasaki ..... G09G 3/3233 345/210
8,400,207 B2 * 3/2013 Tsuchi ..... G09G 3/20 326/82
8,497,828 B2 * 7/2013 Chaji ..... G09G 3/3283 345/82
8,587,507 B2 * 11/2013 Hasegawa ..... G09G 3/3688 345/209
8,653,893 B2 * 2/2014 Tsuchi ..... G09G 3/3275 330/253
8,816,944 B2 * 8/2014 Kim ..... G09G 3/3283 345/77
9,311,844 B2 * 4/2016 Yang ..... G09G 3/22
2002/0011796 A1 * 1/2002 Koyama ..... G09G 3/2022 315/169.1
2005/0062508 A1 3/2005 Nishimura
2005/0099412 A1 5/2005 Kasai
2005/0122321 A1 * 6/2005 Akai ..... G09G 3/3688 345/204
2005/0134537 A1 * 6/2005 Tobita ..... G09G 3/2011 345/87
2005/0156842 A1 * 7/2005 Kato ..... G09G 3/3688 345/89
2006/0186934 A1 8/2006 Nishimura
2006/0214901 A1 * 9/2006 Nagatsuka ..... G09G 3/3291 345/100
2006/0232678 A1 * 10/2006 Choi ..... G09G 3/3233 348/207.11
2006/0262059 A1 * 11/2006 Hashimoto ..... G09G 3/3685 345/89
2006/0279260 A1 * 12/2006 Tsuge ..... G09G 3/006 322/44
2007/0001205 A1 * 1/2007 Kimura ..... G09G 3/3241 257/296
2007/0132674 A1 6/2007 Tsuge
2007/0164935 A1 * 7/2007 Lee ..... G09G 3/3258 345/76
2008/0278420 A1 11/2008 Chang
2009/0002405 A1 * 1/2009 Ozaki ..... G09G 3/325 345/690
2009/0146920 A1 * 6/2009 Miyake ..... G09G 3/3677 345/55
2009/0160848 A1 6/2009 Tsuchi
2010/0073265 A1 * 3/2010 Hirai ..... G09G 3/3241 345/55
2010/0164929 A1 * 7/2010 Chen ..... G09G 3/3688 345/211
2011/0007102 A1 * 1/2011 Ogura ..... G09G 3/3233 345/690
2014/0204071 A1 * 7/2014 Kwon ..... G09G 3/3291 345/212

FOREIGN PATENT DOCUMENTS

TW I270049 1/2007
TW I287777 10/2007
TW 200845772 11/2008
TW I323872 4/2010
TW I404040 8/2013

* cited by examiner

DRIVING CIRCUIT OF DISPLAY PANEL AND DISPLAY APPARATUS USING THE SAME

BACKGROUND OF THE INVENTION

1. Field of the Invention

The present invention generally relates to a driving circuit, in particular, to a driving circuit of a display panel and a display apparatus using the same.

2. Description of Related Art

Along with advances in modern video technology, display apparatuses have been widely used on mobile phones, notebook computers, personal computers, personal digital assistants (PDA) and such display frames of consumer electronic products. In a source driver of the display apparatus, gray-level data are converted to pixel voltages through a digital to analog converter (DAC), and the driving power of the pixel voltage is increased (namely the current value of the pixel voltage is increased) through buffering the pixel voltage by a voltage buffer. However, DACs and voltage buffers have larger circuit areas such that source drivers cannot be made smaller, and the dynamic current and the static current of the DAC and the voltage buffer will consume power dynamically and consume power statically. Wherein, the changes in dynamic current and static current causes stress on the power supply apparatus and causes electromagnetic interference (EMI), further shortening the lifespan of the display apparatus. In addition, when a range of the gray-level of the frame is increased (for example 8 bits is increased to 10 bits), then the circuit area of the digital to analog converter increases significantly, increasing the difficulty of commercialization. Since the trend in miniaturizing circuits, hence how to reduce the circuit area of the source driver and the power consumption is an important design point in the feature.

SUMMARY OF THE INVENTION

The invention provides a driving circuit of a display panel and a display apparatus thereof, which may reduce a circuit area of the driving circuit and lower a power consumption of the driving circuit.

A driving circuit of a display panel of the invention includes a shift register, a latch, a level shifter, a current source and a charge switch. The shift register receives a trigger signal to provide a data latch signal. The latch couples to the shift register, and receives a gray-level data to latch and output the gray-level data according to the data latch signal. The level shifter couples to the latch and provides a charge switch signal according to the gray-level data. The current source provides a charge current. The charge switch couples between the current source and a pixel of the display panel, and receives the charge switch signal to determine whether the current source is coupled to the pixel according to the charge switch signal.

A display apparatus of the invention includes a display panel having a pixel and the aforementioned driving circuit of a display panel.

Based on the above, in a driving circuit and a display panel of a display apparatus according to an embodiment of the invention, since the charge and discharge of the pixels is through current, hence a voltage buffer does not need to be disposed, namely static current is not generated, which may reduce power consumption of the display apparatus and have faster charging speed, and a source driver will not have inrush current. Therefore, the electromagnetic interference of the display apparatus may be reduced.

Several exemplary embodiments accompanied with figures are described in detail below to further describe the disclosure in details.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
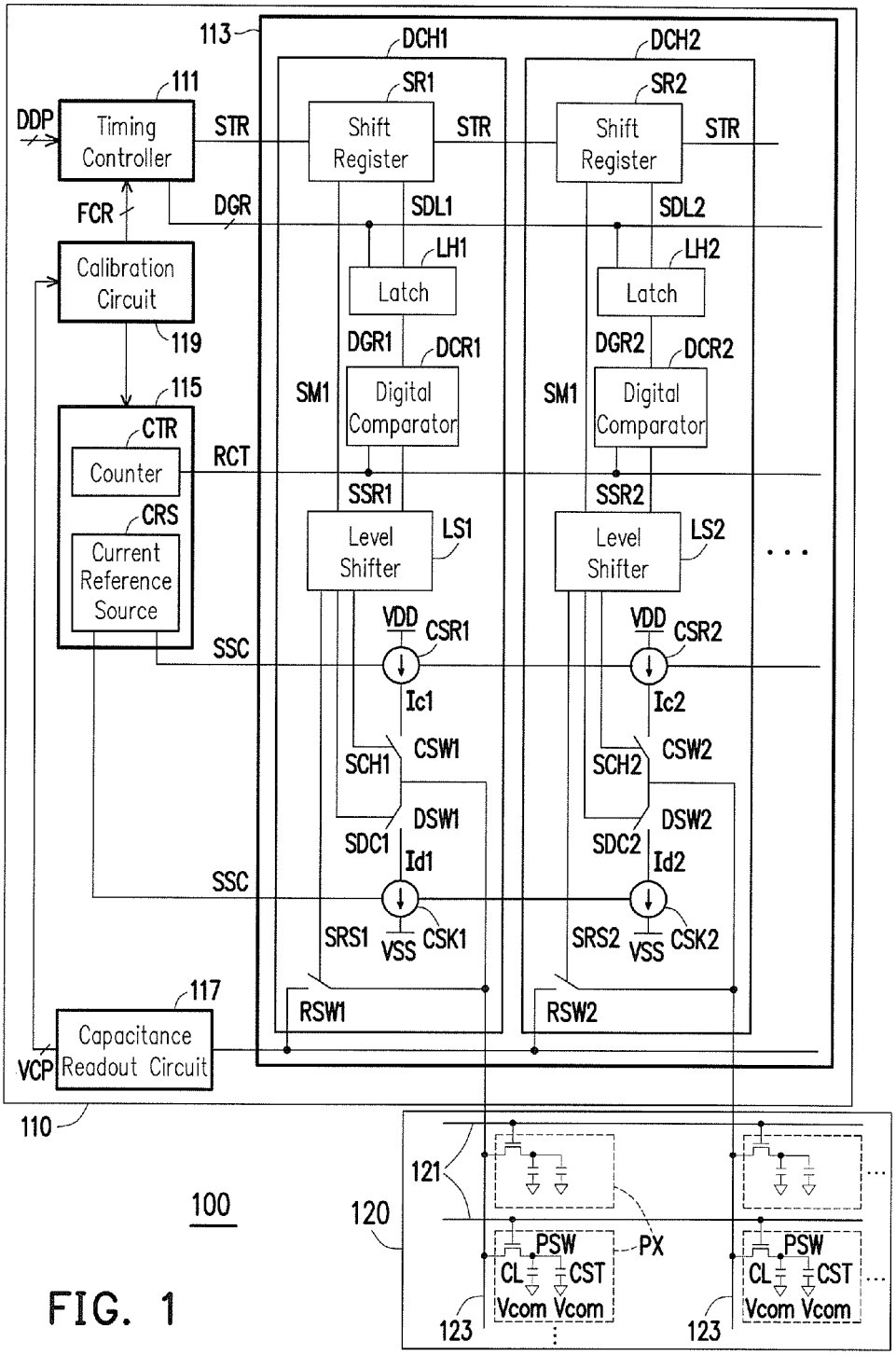
FIG. 1 is a schematic diagram illustrating a system of a display apparatus according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic diagram illustrating a system of a display apparatus according to an embodiment of the invention. Referring to FIG. 1, in the present embodiment, a display apparatus 100 includes a driving circuit 110 and a display panel 120. The driving circuit 110 includes a timing controller 111, a source driver 113, a reference signal generator 115, a capacitance readout circuit 117 and a calibration circuit 119.

The display panel 120 includes a plurality of gate lines 121, a plurality of source lines 123 and a plurality of pixels PX arranged in an array. Each of the pixels PX includes a pixel switch PSW, a liquid crystal capacitor CL and a storage capacitor CST. A gate of the pixel switch PSW is coupled to a corresponding gate line 121. A drain of the pixel switch PSW is coupled to a corresponding source line 123 to be coupled to the source driver 113. The liquid crystal capacitor CL and the storage capacitor CST are coupled in parallel between the source of the pixel switch PSW and a common voltage Vcom.

The timing controller 111 is coupled to the source driver 113 so as to provide a trigger signal STR to the source driver 113 during a frame period, receive a plurality of display data DDP to provide a plurality of gray-level data DGR correspondingly to the source driver 113 during a frame period, and receive calibration factors FCR corresponding to each of the pixels to correspondingly adjust the gray-level data DGR that is provided. The reference signal generator 115 is coupled to the source driver 113 to provide a count result RCT and a current setting signal SSC to the source driver 113. The reference signal generator 115 may include a counter CTR to provide the count result RCT, and include a current reference source CRS to provide the current setting signal SSC, wherein the counter CTR may count the system clock signal (not shown) of the display apparatus 100 or the clock signal that is provided by a phase-locked loop (PLL) to provide the count result RCT.

The source driver 113 is coupled to the timing controller 111 to receive the gray-level data DGR according to the trigger signal STR, and is coupled to the reference signal generator 115 to provide a plurality of charge currents (such as Ic1, Ic2) and discharge currents (such as Id1, Id2) to the pixels PX of the display panel 120 according to the current setting signal SSC, and determines a time for providing the charge current (such as Ic1, Ic2) or the discharge current (such as Id1, Id2) according to the gray-level data DGR and the count result RCT. The voltage across each of the pixels PX determines a current value and a time for providing the charge current (such as Ic1, Ic2) or the discharge current (such as Id1, Id2). Namely, V=I*T/C, wherein V is the voltage across the pixel PX, I is the current value of the charge current (such as Ic1, Ic2) or the discharge current (such as Id1, Id2), and T is the time for providing the charge current (such as Ic1, Ic2) or the discharge current (such as Id1, Id2).

The capacitance readout circuit 117 is coupled to the pixels PX of the display panel 120 through the source driver 113, and is used to read out the capacitance of each of the pixels PX to provide a pixel capacitance value VCP. The calibration circuit 119 is coupled to the timing controller 111, the reference signal generator 115 and the capacitance readout circuit 117, so as to set the frequency (namely a length of time for a cycle of the count result RCT) of the count result RCT and the current setting signal SSC according to the pixel capacitance value VCP, and provide the calibration factors corresponding to each of the pixels PX to the timing controller 111 according to the pixel capacitance value VCP.

In the present embodiment, the source driver 113 has a plurality of data channels (such as DCH1, DCH2), and each of the data channels (such as DCH1, DCH2) includes a shift register (such as SR1, SR2), a latch (such as LH1, LH2), a digital comparator (such as DCR1, DCR2), a level shifter (such as LS1, LS2), a current source (such as CSR1, CSR2), a charge switch (such as CSW1, CSW2), a current sink (such as CSK1, CSK2), a discharge switch (such as DSW1, DSW2) and a readout switch (such as RSW1, RSW2).

The timing controller 111 and the shift registers (such as SR1, SR2) are coupled in series. The latches (such as LH1, LH2) are coupled to the timing controller 111, the corresponding shift register (such as SR1, SR2) and the corresponding digital comparator (such as DCR1, DCR2). The digital comparator (such as DCR1, DCR2) is coupled to the counter CTR and the corresponding level shifter (such as LS1, LS2). The level shifter (such as LS1, LS2) is coupled to the charge switch (such as CSW1, CSW2), the discharge switch (such as DSW1, DSW2) and the readout switch (such as RSW1, RSW2). The current source (such as CSR1, CSR2) and the charge switch (such as CSW1, CSW2) are coupled between a system high voltage VDD and the display panel 120, and the current source (such as CSR1, CSR2) is coupled to the current reference source CRS. The current sink (such as CSK1, CSK2) and the discharge switch (such as DSW1, DSW2) are coupled between the display panel 120 and a system low voltage VSS, and the current sink (such as CSK1, CSK2) is coupled to the current reference source CRS. The readout switch (such as RSW1, RSW2) is coupled between the capacitance readout circuit 117 and the display panel 120.

After the display apparatus 100 is turned-on, the display apparatus 100 first enters a pixel measurement period (namely a pixel measurement mode) to measure the capacitance value of each of the pixels PX, wherein the pixel measurement period is approximately a period for writing a complete frame (namely one frame period). During the pixel measurement period, the shift register (such as SR1, SR2) will transmit the trigger signal STR sequentially, and the shift register (such as SR1, SR2) will provide a measurement signal (such as SM, SM2) to the level shifter (such as LS1, LS2) when the trigger signal STR is received. However, a data latch signal (such as SDL1, SDL2) will not be provided.

Next, the level shifter (such as LS1, LS2) will provide a readout switch signal (such as SRS1, SRS2) according to the measurement signal (such as SM1, SM2). After the readout switch signal (such as SRS1, SRS2) is received, the readout switch (such as RSW1, RSW2) will turn on, namely the readout switch (such as RSW1, RSW2) will determine whether the capacitance readout circuit 117 is coupled to the corresponding pixel PX, and that the capacitance readout circuit 117 is coupled to the pixel PX through the readout switch (such as RSW1, RSW2) and the source line 123 according to the readout switch signal (such as SRS1, SRS2).

After the capacitance readout circuit 117 completes the readout of the capacitances of all the pixels PX, the timing controller 111 will store the calibration factors FCR corresponding to all of the pixels PX. Next, the display apparatus 100 will enter a frame display period (namely a frame display mode). During the frame display period, the shift register (such as SR1, SR2) will transmit the trigger signal STR sequentially, and when the shift register (such as SR1, SR2) receives the trigger signal STR, the data latch signal (such as SDL1, SDL2) is provided to the latch (such as LH1, LH2) according to the trigger signal STR. However, the measurement signal (such as SM, SM2) will not be provided. Wherein, in one frame display period, the timing controller 111 will provide the trigger signal STR once.

Next, the latch (such as LH1, LH2) receives the gray-level data DGR from the timing controller 111, and receives the data latch signal (such as SDL1, SDL2) from the shift register (such as SR1, SR2). When the latch (such as LH1, LH2) receives the data latch signal (such as SDL1, SDL2), the latch (such as LH1, LH2) latches and outputs the gray-level data (such as DGR1, DGR2) to the digital comparator (such as DCR1, DCR2) according to the data latch signal (such as SDL1, SDL2).

The digital comparator (such as DCR1, DCR2) receives the count result RCT from the counter CTR, and receives the latched gray-level data DGR from the latch (such as LH1, LH2). Next, the digital comparator (such as DCR1, DCR2) compares the count result RCT and the corresponding gray-level data DGR (such as DGR1, DGR2) to provide a switch reference signal (such as SSR1, SSR2) to the level shifter (such as LS1, LS2). After the switch reference signal (such as SSR1, SSR2) is received, the level shifter (such as LS1, LS2) provides a charge switch signal (such as SCH1, SCH2) to the charge switch (such as CSW1, CSW2) and provides a discharge switch signal (such as SDC1, SDC2) to the discharge switch (such as DSW1, DSW2) according to the switch reference signal (such as SSR1, SSR2), wherein at least one of the charge switch (such as CSW1, CSW2) or the discharge switch (such as DSW1, DSW2) is cut-off.

Since the switch reference signal (such as SSR1, SSR2) is generated according to the latched gray-level data (such as DGR1, DGR2), hence the charge switch signal (such as SCH1, SCH2) and the discharge switch signal (such as SDC1, SDC2) are generated according to the latched gray-level data (such as DGR1, DGR2). And, the switch reference signal (such as SSR1, SSR2) is generated by comparing the latched gray-level data (such as DGR1, DGR2) and the count result RCT, therefore the turn-on time of the charge switch (such as CSW1, CSW2) and the discharge switch (such as DSW1, DSW2) are related to a count value (namely the count result RCT) of the counter CTR, namely 2 to the power of the number of bits of the count value will equal the range of the gray-level of the display apparatus 100. For example, if the number of bits of the count value is 8, the gray-level data DGR has 256 gray-levels.

After receiving the charge switch signal (such as SCH1, SCH2), the charge switch (such as CSW1, CSW2) determines whether the current source (such as CSR1, CSR2) is coupled to the pixel PX. After receiving the discharge switch signal (such as SDC1, SDC2), the discharge switch (such as DSW1, DSW2) determines whether the current sink (such as CSK1, CSK2) is coupled to the pixel PX.

After coupling the current source (such as CSR1, CSR2), the pixel PX perform charging according to the charge current (such as Ic1, Ic2), therefore the voltage across the pixels PX will increase. On the other hand, after coupling the current sink (such as CSK1, CSK2), the pixels PX performs discharging according to the discharge current (such as Id1, Id2), therefore the voltage across the pixels PX will decrease.

In an embodiment of the invention, the voltage across the pixels PX may first be returned to the common voltage Vcom through charging or discharging and then the voltage across the pixels PX may be increased or decreased to a target voltage (namely achieving the desired gray-level value for display) through charging or discharging. Or, the voltage across the pixels PX may be increased or decreased to a target voltage (namely achieving the desired gray-level value for display) directly through charging or discharging and it should not be construed as a limitation to the invention.

According to the above, since the charge and discharge of the pixels PX is through current, hence a voltage buffer does not need to be disposed, namely static current is not generated, which may reduce power consumption of the display apparatus 100 and may have faster charging speed, and the source driver 113 will not have inrush current. Therefore, the electromagnetic interference (EMI) of the display apparatus 100 may be reduced. In addition, the number of bits of the gray-level data DGR of the display apparatus 100 is the same as the number of bits of the count result RCT, and the gray-level data DGR is not converted through a digital-to-analog converter, therefore when the gray-level range of the display apparatus 100 increases, the circuit volume of the source driver 113 will not increase significantly.

Figure 2:
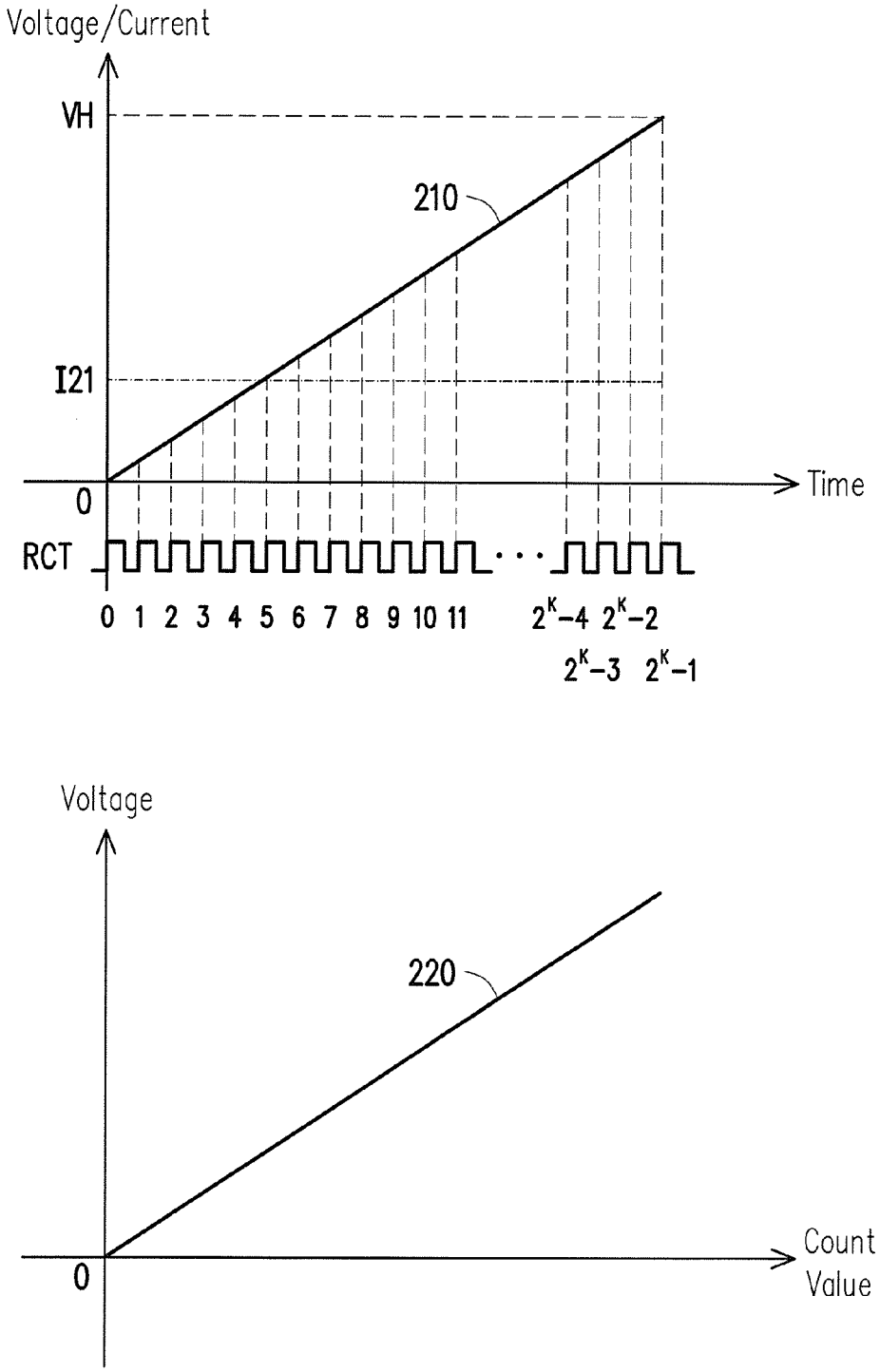
FIG. 2 is a schematic diagram illustrating a driving waveform of a driving circuit according to a first embodiment of the invention.

FIG. 2 is a schematic diagram illustrating a driving waveform of a driving circuit according to a first embodiment of the invention. Referring to FIG. 1 and FIG. 2, in the present embodiment, the charge currents (such as Ic1, Ic2) and the discharge currents (such as Id1, Id2) are fixed current values, namely the current values of the charge currents (such as Ic1, Ic2) and discharge currents (such as Id1, Id2) are fixed as current 21. In addition, the count result RCT of the counter CTR is a fixed frequency, namely the beat frequency of the count result RCT is fixed. Wherein, a voltage VH is a maximum voltage across the pixels PX, and K is a positive integer and is equal to the number of bits of the count result RCT. Under the conditions of a fixed current value of the charge currents (such as Ic1, Ic2), the voltage across the pixels PX will increase linearly (such as shown by the line 210) along with time, and under conditions of a fixed frequency of the count result RCT, the voltage across the pixels PX and the count value of the count result RCT are also rendered a linear relationship (such as shown by the line 210), namely a gamma curve of the present embodiment is linear.

Figure 3:
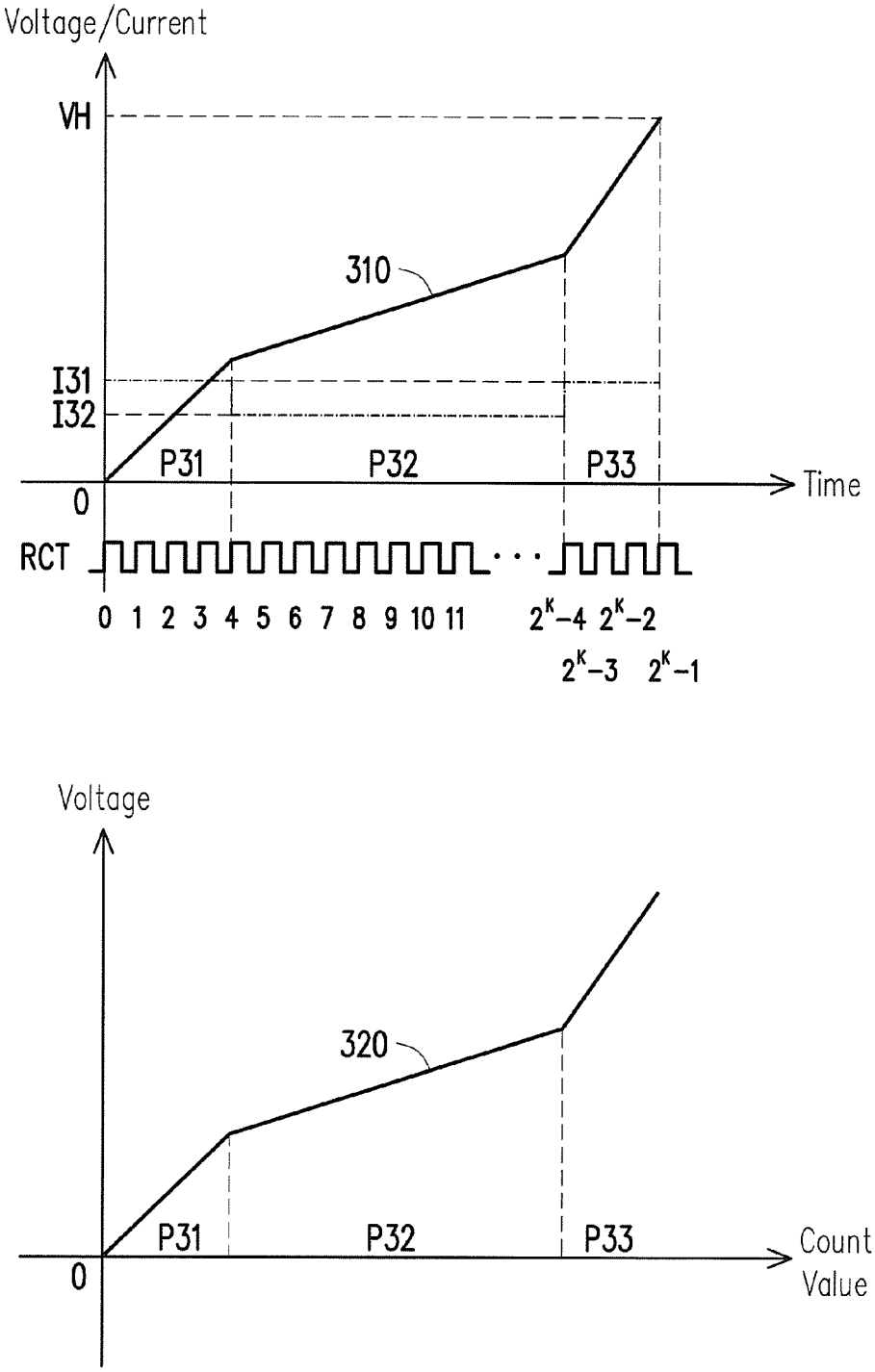
FIG. 3 is a schematic diagram illustrating a driving waveform of a driving circuit according to a second embodiment of the invention.

FIG. 3 is a schematic diagram illustrating a driving waveform of a driving circuit according to a second embodiment of the invention. Referring to FIG. 1 and FIG. 3, in the present embodiment, the charge currents (such as Ic1, Ic2) and the discharge currents (such as Id1, Id2) are time-varying current values, for example, during a period P31 and P33 the current values of the charge currents (such as Ic1, Ic2) and discharge currents (such as Id1, Id2) are fixed as current I31, and during a period P32 the current values of the charge currents (such as Ic1, Ic2) and discharge currents (such as Id1, Id2) are fixed as current I32. In addition, the count result RCT of the counter CTR is a fixed frequency, namely the beat frequency of the count result RCT is fixed. Wherein, a voltage VH is a maximum voltage across the pixels PX, and K is a positive integer and is equal to the number of bits of the count result RCT. Under the conditions of varying current values of the charge currents (such as Ic1, Ic2), the voltage across the pixels PX at different periods (such as P31~P33) will have different slopes (such as shown by the line 310), and under conditions of a fixed frequency of the count result RCT, the corresponding relationship of the voltage across the pixels PX and the count value of the count result RCT are rendered as different slopes (such as shown by the line 320) corresponding to different periods (such as P31~P33), namely the gamma curve of the present embodiment is linear in sections.

Figure 4:
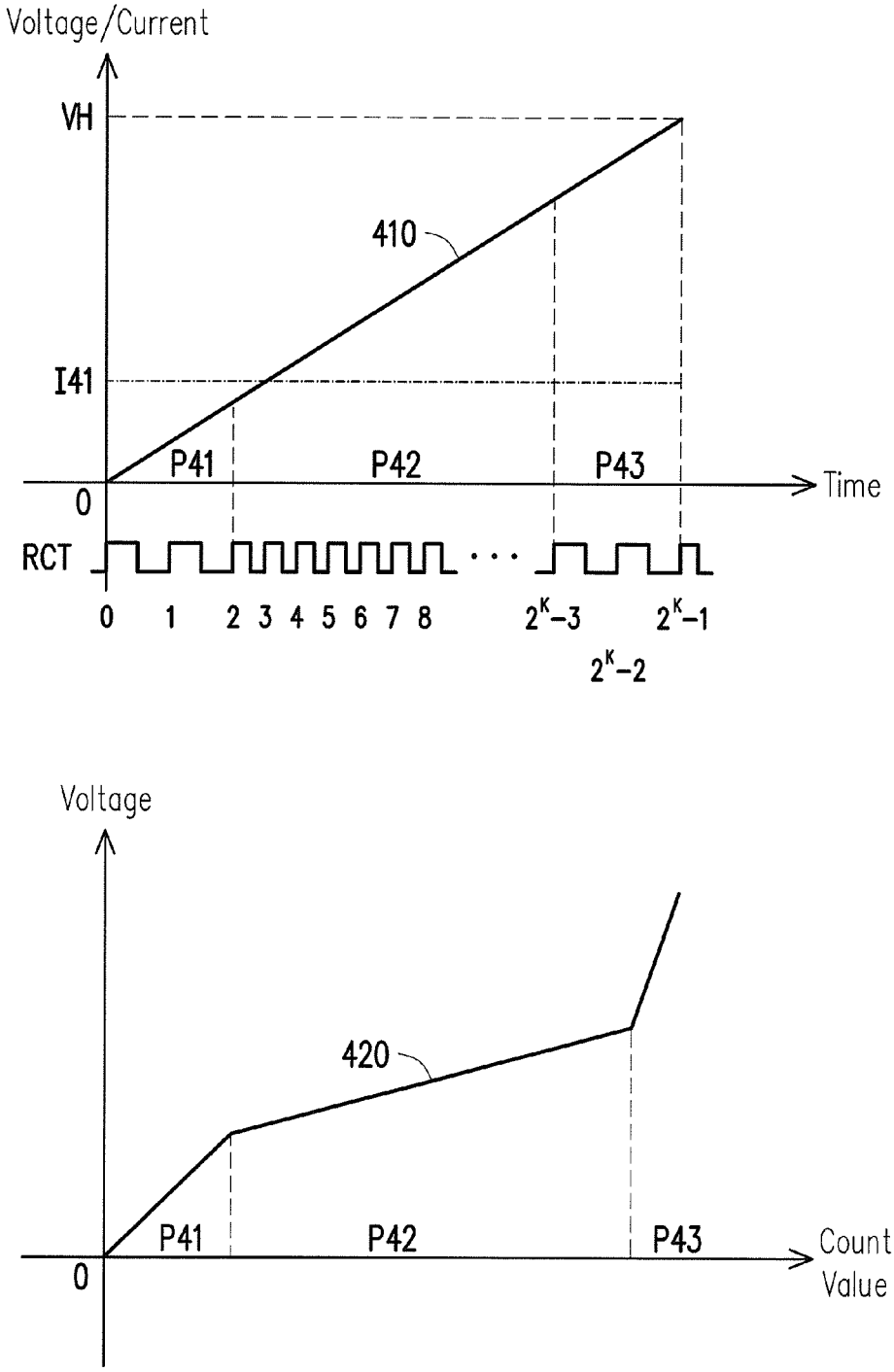
FIG. 4 is a schematic diagram illustrating a driving waveform of a driving circuit according to a third embodiment of the invention.

FIG. 4 is a schematic diagram illustrating a driving waveform of a driving circuit according to a third embodiment of the invention. Referring to FIG. 1 and FIG. 4, in the present embodiment, the charge currents (such as Ic1, Ic2) and the discharge currents (such as Id1, Id2) are fixed current values, namely the current values of the charge currents (such as Ic1, Ic2) and discharge currents (such as Id1, Id2) are fixed as current I41. In addition, the count result RCT of the counter CTR is a time-varying frequency, for example, the beat frequency of the count result RCT during the period P41 and P43 are slower, and the beat frequency of the count result RCT during the period P42 is faster. Wherein, the voltage VH is the maximum voltage across the pixels PX, and K is a positive integer and is equal to the number of bits of the count result RCT. Under the conditions of fixed current values of the charge currents (such as Ic1, Ic2), the voltage across the pixels PX will increase linearly (such as shown by the line 410) along with time, and under conditions of a varying frequency of the count result RCT, the corresponding relationship of the voltage across the pixels PX and the count value of the count result RCT are rendered as different slopes (such as shown by the line 420) corresponding to different periods (such as P41~P43), namely the gamma curve of the present embodiment is linear in sections.

Figure 5:
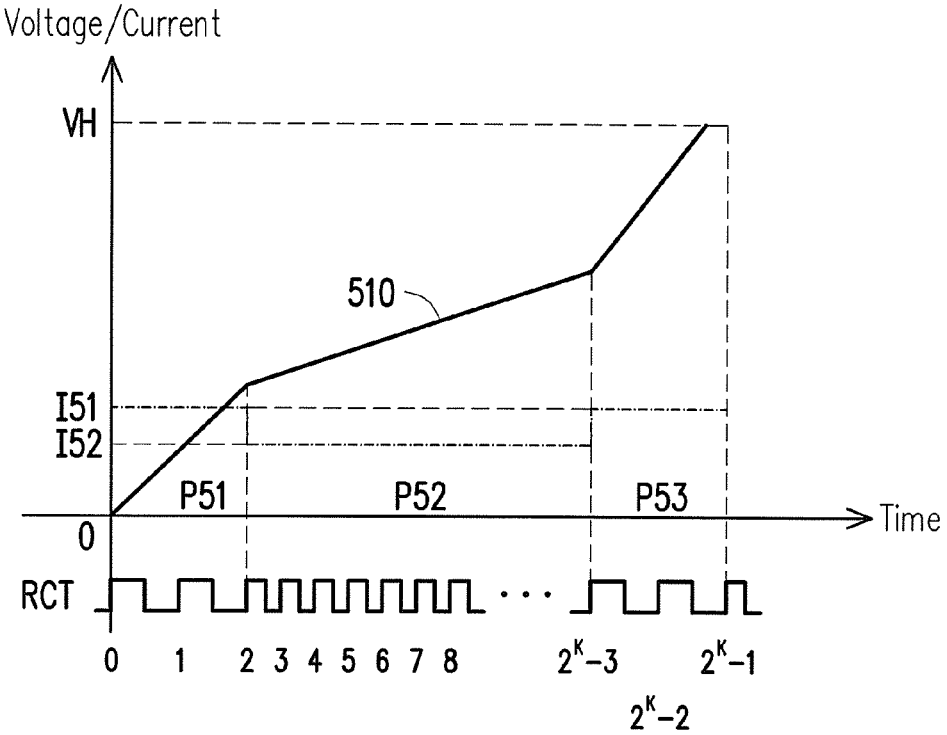
FIG. 5 is a schematic diagram illustrating a driving waveform of a driving circuit according to a fourth embodiment of the invention.
Figure 5:
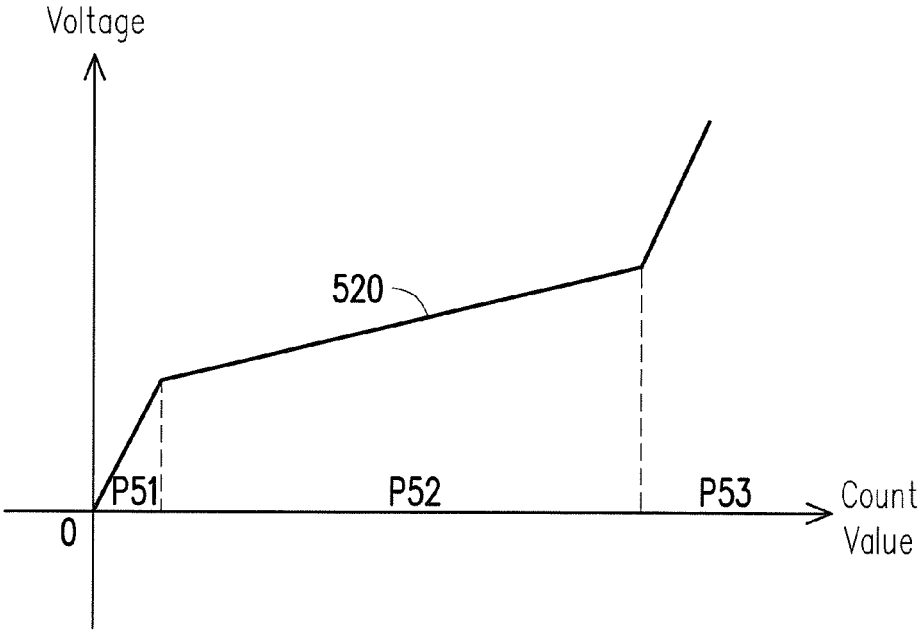

FIG. 5 is a schematic diagram illustrating a driving waveform of a driving circuit according to a fourth embodiment of the invention. Referring to FIG. 1 and FIG. 5, in the present embodiment, the charge currents (such as Ic1, Ic2) and the discharge currents (such as Id1, Id2) are time-varying current values, for example, during a period P51 and P53, the current values of the charge currents (such as Ic1, Ic2) and discharge currents (such as Id1, Id2) are fixed as current I51, and during a period P52 the current values of the charge currents (such as Ic1, Ic2) and discharge currents (such as Id1, Id2) are fixed as current I52. In addition, the count result RCT of the counter CTR is a time-varying frequency, for example, the beat frequency of the count result RCT during the period P51 and P53 are slower, and the beat frequency of the count result RCT during the period P52 is faster. Wherein, the voltage VH is the maximum voltage across the pixels PX, and K is a positive integer and is equal to the number of bits of the count result RCT. Under the conditions of varying current values of the charge currents (such as Ic1, Ic2), the voltage across the pixels PX at different periods (such as P51~P53) will have different slopes (such as shown by the line 510), and under conditions of a varying frequency of the count result RCT, the corresponding relationship of the voltage across the pixels PX and the count value of the count result RCT are rendered as different slopes (such as shown by the line 520) corresponding to different periods (such as P51~P53), namely the gamma curve of the present embodiment is linear in sections.

Figure 6:
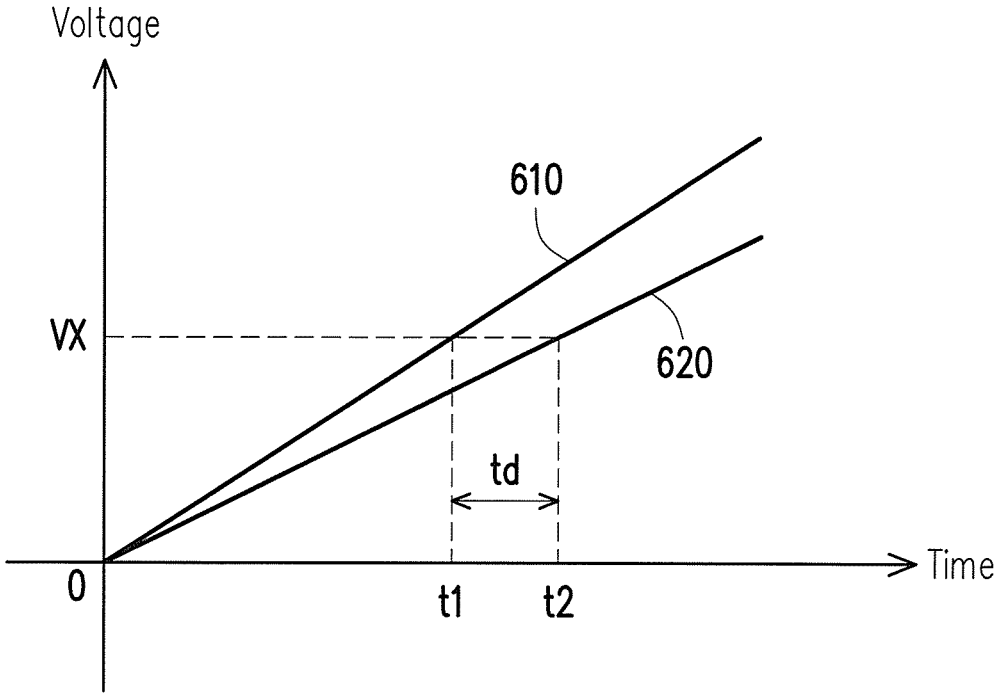
FIG. 6 is a schematic diagram illustrating a compensation of pixel capacitance according to an embodiment of the invention.

FIG. 6 is a schematic diagram illustrating a compensation of a pixel capacitance according to an embodiment of the invention. Referring to FIG. 1 and FIG. 6, in the present embodiment, the charge currents (such as Ic1, Ic2) and the discharge currents (such as Id1, Id2) are fixed current values, therefore when the capacitance value is lower, the increasing curve of the voltage across the pixels PX is such as shown by 610, and when the capacitance value is higher, the increasing curve of the voltage across the pixels PX is such as shown by 620. Using a target voltage VX as an example, the time required for the curve 610 is t1, and the time required for the curve 620 is t2.

Suppose the curve 610 corresponds to a predetermined capacitance value (namely a reference value needed for designing the system), and the curve 620 is the actual capacitance value corresponding to the pixels PX. Here, the pixels PX require more time for performing charging (such as shown by the time td) to achieve the target voltage VX, wherein t2=t1(C2/C1), C1 is the capacitance value corresponding to the curve 610, and C2 is the capacitance value corresponding to the curve 620. Therefore, gray-level data DGR corresponding to the pixels PX may be amplified correspondingly to obtain a sufficient charging time. In other words, the calibration factors corresponding to each of the pixels PX may be data gain values to amplify the corresponding gray-level data DGR, and the aforementioned data gain values are equal to the ratio (namely C2/C1) of the pixel capacitance value (such as the aforementioned C2) to the predetermined capacitance value (such as the aforementioned C1).

Figure 7:
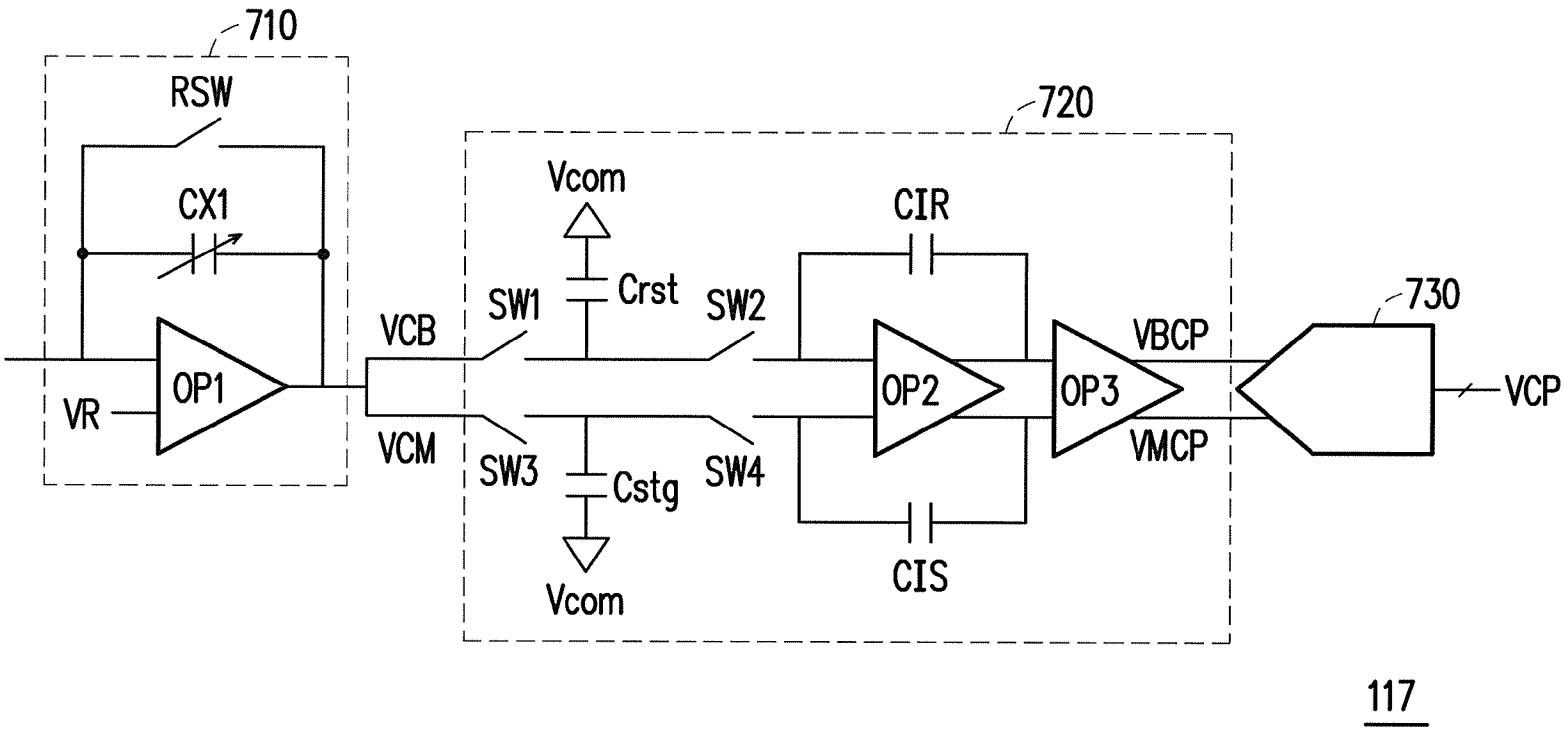
FIG. 7 is a schematic circuit diagram illustrating a capacitance readout circuit according to an embodiment of the invention.

FIG. 7 is a schematic circuit diagram illustrating a capacitance readout circuit according to an embodiment of the invention. Referring to FIG. 1 and FIG. 7, in the present embodiment, the capacitance readout circuit 117 includes a charge amplifier 710, a correlated double sampling circuit 720 (CDS circuit) and an analog-to-digital converter 730 (ADC). The charge amplifier 710 is coupled to the pixels PX to provide a capacitance base voltage VCB and a capacitance measurement voltage VCM sequentially. The correlated double sampling circuit 720 is coupled to the charge amplifier 710 to provide a base capacitance value voltage VBCP according to the capacitance base voltage VCB, and provide a measurement capacitance value voltage VMCP according to the capacitance measurement voltage VCM. The ADC 730 is coupled to the correlated double sampling circuit 720 to provide the pixel capacitance value VCP according to the base capacitance value voltage VBCP and the measurement capacitance value voltage VMCP.

More specifically, the charge amplifier 710 includes a switch RSW, a capacitor CX1 and an operational amplifier OP1, wherein the switch RSW and the capacitor CX1 are coupled in parallel between a first input terminal and an output terminal of the operational amplifier OP1. The second input terminal of the operational amplifier OP1 receives a reference voltage VR. The correlated double sampling circuit 720 includes switches SW1~SW4, capacitors Crst, Cstg, CIR, CIS and operational amplifiers OP2, OP3. The switches SW1 and SW2 are coupled in series between the output terminal of the operational amplifier OP1 and a first input terminal of the operational amplifier OP2. The capacitor Crst is coupled between the switches SW1, SW2 and the common voltage Vcom. The switches SW3 and SW4 are coupled in series between the output terminal of the operational amplifier OP1 and a second input terminal of the operational amplifier OP2. The capacitor Cstg is coupled between the switches SW3, SW4 and the common voltage Vcom. The capacitor CIR is coupled in parallel between the first input terminal and a first output terminal of the operational amplifier OP2 to form an integrator. The capacitor CIS is coupled in parallel between the second input terminal and a second output terminal of the operational amplifier OP2 to form an integrator. A first input terminal of the operational amplifier OP3 is coupled to the first output terminal of the operational amplifier OP2 to amplify the analog voltage received, and then provides the base capacitance value voltage VBCP by a first output terminal of the operational amplifier OP3. In addition, a second input terminal of the operational amplifier OP3 is coupled to the second output terminal of the operational amplifier OP2 to amplify the analog voltage received, and then provides the measurement capacitance value voltage VMCP by a second output terminal of the operational amplifier OP3.

In summary, in a driving circuit and a display panel of a display apparatus according to an embodiment of the invention, since the charge and discharge of the pixels is through current, hence a voltage buffer does not need to be disposed, namely static current is not generated, which may reduce power consumption of the display apparatus and have faster charging speed, and a source driver will not have inrush current. Therefore, the electromagnetic interference of the display apparatus may be reduced. In addition, a number of bits of gray-level data of the display apparatus is the same as a number of bits of a count result, and the gray-level data is not converted through a digital-to-analog converter, therefore when the gray-level range of the display apparatus increases, the circuit volume of the source driver will not increase significantly.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving circuit of a display panel, comprising:

a shift register, receiving a trigger signal to provide a data latch signal;

a latch, coupled to the shift register, and receiving a gray-level data to latch and output the gray-level data according to the data latch signal;

a level shifter, coupled to the latch and providing a charge switch signal according to the gray-level data;

a current source, providing a charge current; and a charge switch, coupled between the current source and a pixel of the display panel, and receiving the charge switch signal to determine whether the current source is coupled to the pixel according to the charge switch signal, a current sink, receiving a discharge current; and a discharge switch, coupled between the current sink and the pixel, and coupled to the level shifter to receive a discharge switch signal, the discharge switch determining whether the current sink is coupled to the pixel according to the discharge switch signal.

2. The driving circuit of a display panel as claimed in claim 1, further comprising:

a digital comparator, coupled to the latch and the level shifter to receive a count result and the gray-level data, and comparing the count result and the gray-level data to provide a switch reference signal to the level shifter, wherein the level shifter provides the charge switch signal according to the switch reference signal.

3. The driving circuit of a display panel as claimed in claim 2, further comprising:

a reference signal generator, coupled to the digital comparator to provide the count result, and coupled to the current source and the current sink to provide a current setting signal to the current source and the current sink.

4. The driving circuit of a display panel as claimed in claim 3, wherein the count result is a fixed frequency.

5. The driving circuit of a display panel as claimed in claim 3, wherein the count result is a time-varying frequency.

6. The driving circuit of a display panel as claimed in claim 3, further comprising:

a timing controller, coupled to the latch and the shift register, and receiving display data to provide the gray-level data to the latch, and providing the trigger signal to the shift register.

7. The driving circuit of a display panel as claimed in claim 6, further comprising:

a capacitance readout circuit, used to read a capacitance value of the pixel to provide a pixel capacitance value;

a readout switch, coupled to the capacitance readout circuit and the pixel, and receiving a readout switch signal to determine whether the capacitance readout circuit is coupled to the pixel according to the readout switch signal; and a calibration circuit, coupled to the capacitance readout circuit, the reference signal generator and the timing controller, so as to set a frequency of the count result and the current setting signal according to the pixel capacitance, and provide a calibration factor to the timing controller according to the pixel capacitance to adjust the gray-level data provided by the timing controller.

8. The driving circuit of a display panel as claimed in claim 7, wherein the capacitance readout circuit comprises:

a charge amplifier, coupled to the pixel to provide a capacitance base voltage and a capacitance measurement voltage sequentially;

a correlated double sampling circuit, coupled to the charge amplifier to provide a base capacitance voltage according to the capacitance base voltage, and provide a measurement capacitance voltage according to the capacitance measurement voltage; and an analog-to-digital converter, coupled to the correlated double sampling circuit to provide the pixel capacitance according to the base capacitance value voltage and the measurement capacitance voltage.

9. The driving circuit of a display panel as claimed in claim 7, wherein the calibration factor is a data gain value, and the data gain value is equal to a ratio of the pixel capacitance to a predetermined capacitance.

10. The driving circuit of a display panel as claimed in claim 7, wherein during a pixel measurement period, the shift register provides a measurement signal to the level shifter according to the trigger signal, and the level shifter provides the readout switch signal according to the measurement signal, and during a pixel display period, the shift register provides the data latch signal to the latch according to the trigger signal.

11. The driving circuit of a display panel as claimed in claim 1, wherein the charge current and the discharge current are fixed current values.

12. The driving circuit of a display panel as claimed in claim 1, wherein the charge current and the discharge current are time-varying current values.

13. A display apparatus, comprising:

a display panel, having a pixel; and a driving circuit, comprising:

a shift register, receiving a trigger signal to provide a data latch signal;

a latch, coupled to the shift register, and receiving a gray-level data to latch and output the gray-level data according to the data latch signal;

a level shifter, coupled to the latch and providing a charge switch signal according to the gray-level data;

a current source, providing a charge current; and a charge switch, coupled between the current source and a pixel of the display panel, and receiving the charge switch signal to determine whether the current source is coupled to the pixel according to the charge switch signal, a current sink, receiving a discharge current; and a discharge switch, coupled between the current sink and the pixel, and coupled to the level shifter to receive a discharge switch signal, the discharge switch determining whether the current sink is coupled to the pixel according to the discharge switch signal.

14. The display apparatus as claimed in claim 13, the driving circuit further comprising:

a digital comparator, coupled to the latch and the level shifter to receive a count result and the gray-level data, and comparing the count result and the gray-level data to provide a switch reference signal to the level shifter, wherein the level shifter provides the charge switch signal according to the switch reference signal.

15. The display apparatus as claimed in claim 14, further comprising:

a reference signal generator, coupled to the digital comparator to provide the count result, and coupled to the current source and the current sink to provide a current setting signal to the current source and the current sink.

16. The display apparatus as claimed in claim 15, the driving circuit further comprising:

a capacitance readout circuit, used to read a capacitance value of the pixel to provide a pixel capacitance;

a readout switch, coupled to the capacitance readout circuit and the pixel, and receiving a readout switch signal to determine whether the capacitance readout circuit is coupled to the pixel according to the readout switch signal; and a calibration circuit, coupled to the capacitance readout circuit, the reference signal generator and a timing controller, so as to set a frequency of the count result and the current setting signal according to the pixel capacitance, and provide a calibration factor to the timing controller according to the pixel capacitance to adjust the gray-level data provided by the timing controller.

17. The display apparatus as claimed in claim 16, wherein the capacitance readout circuit comprises:

a charge amplifier, coupled to the pixel to provide a capacitance base voltage and a capacitance measurement voltage sequentially;

a correlated double sampling circuit, coupled to the charge amplifier to provide a base capacitance voltage according to the capacitance base voltage, and provide a measurement capacitance voltage according to the capacitance measurement voltage; and an analog-to-digital converter, coupled to the correlated double sampling circuit to provide the pixel capacitance according to the base capacitance voltage and the measurement capacitance voltage.

18. The display apparatus as claimed in claim 16, wherein the calibration factor is a data gain value, and the data gain value is equal to a ratio of the pixel capacitance to a predetermined capacitance.

* * * * *